United States Patent [19]

Winch et al.

[11] 4,425,842

[45] Jan. 17, 1984

[54] HIGH EXPRESSION SQUEEZE ROLL LIQUOR EXTRACTION OF NONWOVEN BATTS

[75] Inventors: Allen R. Winch, Westfield, N.J.; William A. Rearick, Simpsonville, S.C.

[73] Assignee: Cotton Incorporated, New York, N.Y.

[21] Appl. No.: 259,567

[22] Filed: May 1, 1981

[51] Int. Cl.[3] ..... D06B 15/02

[52] U.S. Cl. ..... 100/37; 68/267; 100/118; 100/153; 162/205; 162/358; 210/DIG. 3; 210/386; 210/783

[58] Field of Search ..... 100/37, 118, 153; 8/151, 156; 68/21, 22 R, 45, 99, 244, 267; 162/205, 358; 210/386, 783, DIG. 3

[56] References Cited

U.S. PATENT DOCUMENTS

| | | | |
|---|---|---|---|
| 77,861 | 5/1868 | Baker . | |
| 445,003 | 1/1891 | Hoeborn | 162/358 X |
| 598,456 | 2/1898 | Wenk . | |
| 619,614 | 2/1899 | Quirin . | |
| 620,786 | 3/1899 | Koerper et al. | 210/386 |
| 761,878 | 6/1904 | Cooley . | |
| 1,583,722 | 5/1926 | Kehrhahn . | |
| 1,843,208 | 2/1932 | Cutler | 210/DIG. 3 |
| 1,925,917 | 9/1933 | Chalon | 162/358 X |
| 1,955,813 | 4/1934 | Klappenecker . | |
| 2,048,754 | 7/1936 | Putnam . | |
| 2,060,897 | 11/1936 | Richardson et al. . | |
| 2,209,759 | 7/1940 | Berry . | |
| 2,365,658 | 12/1944 | Schumacher . | |
| 2,622,722 | 12/1952 | Lucas . | |
| 2,711,130 | 4/1949 | Guettler . | |
| 2,750,679 | 6/1956 | Cohn et al. . | |
| 2,858,689 | 11/1958 | Smith . | |
| 2,963,161 | 12/1960 | Holland | 210/DIG. 3 |
| 3,035,512 | 5/1962 | Beachler . | |
| 3,090,488 | 5/1963 | Komline et al. | 210/786 |
| 3,198,695 | 8/1965 | Justus . | |
| 3,261,184 | 7/1966 | Cohn et al. . | |
| 3,270,532 | 9/1966 | Chaikin et al. . | |
| 3,315,370 | 4/1967 | Hikosaka . | |
| 3,331,734 | 7/1967 | Rojecki . | |
| 3,599,853 | 8/1971 | Munch . | |
| 3,654,781 | 4/1972 | Plechac . | |
| 3,726,749 | 4/1973 | Mistarz et al. . | |
| 3,947,113 | 3/1976 | Buchan et al. . | |
| 3,958,432 | 5/1976 | Aronoff . | |
| 4,118,958 | 10/1978 | Lemon et al. . | |

FOREIGN PATENT DOCUMENTS

| | | | |
|---|---|---|---|
| 158435 | 3/1905 | Fed. Rep. of Germany . | |
| 308011 | 9/1918 | Fed. Rep. of Germany | 162/358 |
| 480846 | 7/1929 | Fed. Rep. of Germany . | |
| 1155972 | 10/1963 | Fed. Rep. of Germany | 162/358 |
| 146027 | 12/1968 | Fed. Rep. of Germany . | |
| 562844 | 12/1923 | France . | |
| 34599 | 12/1964 | German Democratic Rep. . | |
| 2096 | of 1892 | United Kingdom . | |
| 29438 | of 1910 | United Kingdom . | |
| 629310 | 8/1949 | United Kingdom . | |
| 868288 | 5/1961 | United Kingdom . | |
| 985114 | 3/1965 | United Kingdom . | |
| 1514647 | 6/1978 | United Kingdom . | |
| 1599347 | 9/1981 | United Kingdom . | |

*Primary Examiner*—Philip R. Coe

*Attorney, Agent, or Firm*—Burns, Doane, Swecker & Mathis

[57] ABSTRACT

A squeeze roll arrangement and method is disclosed for high expression squeeze roll liquor expression of nonwoven fiber batts. An auxiliary conveyor belt is provided to squeeze the batt before passing through the nip of the squeeze rolls with the batt. In this way, a portion of the liquor carried by the batt is expressed prior to passage of the batt through the nip. Since the batt is carried by the auxiliary conveyor belt, disruption of the batt is minimized. Preferably, chains are provided on either side of the batt to maintain a preferred orientation of the batt. Various sprockets and pulleys are provided as desired to guide the chains with various turn rollers provided to carry the conveyor belt. The chains are flexibly attached to the edges of the belt to continuously guide the belt. In this way, alignment of the belt on the turn and squeeze rolls is maintained.

22 Claims, 7 Drawing Figures

32
22
37
60
24
23
44c
72
60
30
70
25
30
70
21
60
44c
37
32
60
23

21
22
60
44c
37
30
70
72
24
23
60
30
70
72

HIGH EXPRESSION SQUEEZE ROLL LIQUOR EXTRACTION OF NONWOVEN BATTS

BACKGROUND AND SUMMARY OF THE INVENTION

The present invention relates to a method and apparatus for expressing liquor from a moving fiber batt.

Textile fibers are typically wet treated as staple or in heavy weight, nonwoven batt-like formations prior to subsequent light weight, nonwoven web formation or yarn spinning. For example, the scouring and bleaching of cotton fiber for use in the manufacture of medical and health care products is currently carried out in batch-kier processes. Some textile fibers are also stock dyed in batch processes in large dye kettles, vats, or kiers prior to carding and spinning. Other chemical treatments may at times be applied more advantageously to textile fibers in "stock" or "staple" form rather than to yarn or to fabric.

For technical and economic reasons, however, it is preferable to wash, scour, bleach, dye or otherwise treat textile fibers by continuous processes rather than by batch processes. In such continuous processes, it is frequently preferable to apply such chemical treating liquors to fibers which have been opened, carded, and/or otherwise formed into long continuous nonwoven batts weighing at least 8 oz. per square yard and typically ranging from about 16 oz. to about 48 oz. of dry fiber per square yard of batt.

In wet physical or chemical treatments such as those described above, the treatments may be applied to textile fibers that have been prepared in continuous batt form. The fibers to be treated may preferably be transported upon a series of endless belts through a series of small volume chemical processing vessels (which are relatively long and shallow, rather than deep) in order to apply a planned sequence of wet physical or chemical treatments. As the fiber (in a continuous batt-like form, supported by a series of endless conveyor belts) passes from one wet processing step to another wet processing step, it is generally desirable to reduce the percentage of total wet pickup of a treating liquor (and accordingly the weight) with respect to a dry fiber batt. After the batt passes out of the treating liquor of an impregnation vessel, the batt is passed into other processing vessels. These could include another impregnator, a rinser, an aging (reacting) chamber, a drier, or a subsequent treating liquor vessel (impregnator).

Reduction of the percentage of wet pickup to a desired process control application level between any two given processing stages may be accomplished, for example, by the use of paired squeeze rolls, or by the use of a vacuum slot or plenum device. However, a vacuum slot requires specially designed equipment to provide a suitable vacuum, and, for nonwoven batts, a specially designed conveyor belt or perforated drum is necessary to carry the batt over the vacuum slot or the plenum.

An important commercial interest is concerned with improved devices and methods for employing paired high expression squeeze or nip rolls to squeeze excess treating liquor from the batt. To obtain high expression efficiency, it is sometimes impractical to pass the impregnator or rinser primary conveyor belt along with the superimposed batt through the nip between the high expression squeeze rolls. Especially in the case of fibrous batts possessing highly competitive capillary systems relative to the capillary pore structure and pore volume of the supporting conveyor belt, it is not readily practical to pass both the belt and batt through the nip of the rolls.

When both the belt and the batt are passed through the nip, the conveyor belt is generally porous to permit the liquor expressed by the paired squeeze roll nip to drain through the belt. Unfortunately, the pore structure of the belt typically retains a significant amount of liquor per unit area of belt as the batt and belt pass together through the nip of the paired squeeze rolls. Then, as the batt and the belt emerge in close capillary contact with each other, downstream of the nip, the fine capillary structure of the fiber batt typically re-absorbs liquor from the coarser pore structure of the belt. Such re-absorption lowers the efficiency of the nip rolls in expressing liquor from the batt. Hence, usually it is preferred to use separate conveyor belts, one belt carrying the batt up to the input side of the nip rolls, and the second belt carrying the batt away from the nip rolls.

Whenever the batt is passed through the nip not supported on a conveyor belt, considerable ingenuity must be employed in arranging the conveyor belts and in positioning the belt turn rolls both immediately upstream and immediately downstream of the high expression squeeze rolls in order to assure smooth operational transfer of the batt. The batt must be transferred from the first belt into the nip of the squeeze rolls, and then from the squeeze rolls onto the next conveyor belt. Even though proper attention to such details can greatly improve the transfer efficiency of the batt, there remains a potentially troublesome problem.

If the liquor being expressed from the batt at the nip of the high pressure squeeze rolls is too copious, the weight of the flow of liquor will be sufficiently heavy to cause the batt to distort and rupture. Such a situation is more likely to occur with relatively heavier weight batts at higher linear rates of batt travel through the squeeze rolls. A heavier weight batt increases the volume of liquor expressed per unit length of batt and hence per unit time. Higher linear speeds of batt travel also increase the volume of liquor expressed per unit time.

Many attempts have been made to overcome the problem of batt rupture at high rates of liquor expression but these attempts have been found to be ineffective, mechanically troublesome, and/or excessively costly to employ. For example, a plurality of sets of paired nip rolls could be employed in a tandem sequence to reduce the liquor content of the batt in a series of fractional steps. However, such a deployment of a series of paired nip rolls not only adds significantly to the capital, space, and energy costs, but also adds to the number of potentially troublesome transfer points.

In view of the economic advantages gained by processing heavier area density fiber batts at higher linear speeds through paired high expression squeeze rolls, each pair positioned immediately after an impregnator or rinser, considerable effort has been expended toward the improvement of squeeze roll arrangements. In particular, considerable effort was made to adapt various conveyor belt fabric designs and various endless belt conveyance designs in an auxiliary batt transfer belt passing through the nip with the batt to provide an arrangement which satisfies process efficiency requirements. An efficient process requires that the use of such an auxiliary batt transfer belt (a) does not interfere significantly with the efficiency of the squeeze rolls in expressing the rinsing or the treating liquors from the batt, (b) that the high volume of liquor expressed from the batt does not rupture or disrupt the uniform fiber formation of the batt, (c) that the conveyor belt track properly during the travel of the endless belt through its endless path about turn rolls and through the nip of the squeeze rolls, and (d) that the conveyor belt retains the integrity of its essential dimensional characteristics of length and width.

Many alternatives in the known arts of conveyor belt technology were evaluated in efforts to achieve criteria (a), (b), (c), and (d) above for efficiently processing wet nonwoven fiber batts through high expression squeeze rolls at liquor expression rates ranging from about 40 to 280 pounds of treating liquor per minute, equal to about 4.8 to 33.5 gallons per minute from cotton fiber batts measuring 42 inches wide, weighing from about 12 ounces per square yard to about 32 ounces per square yard. However, none of the existing known prior art systems were satisfactory for achieving the combined criteria (a), (b), (c) and (d) noted above. Some of the reasons for the inadequacy of known prior art conveyor belt systems are discussed below.

First, in order to meet criterion (b), the conveyor belt must be sufficiently porous to pass a large portion of the liquor expressed from the batt through the belt. To be satisfactory, the liquor from the batt must pass through porous openings in the conveyor belt in a path normal to the face of the belt fabric by reason of the pressure exerted on the batt by the belt and the upper squeeze roll (just prior to the entry of the belt and the batt into the nip of the paired high expression nip rolls). A solid non-porous belt is unsatisfactory since all of the liquor so expressed must flow in a generally horizontal and disruptive flow direction more or less parallel to the axes of the squeeze rolls, and outwardly from the center of the fabric toward the selvedges of the batt. Consquently, the total mass of liquor building up in and around the batt at the nip causes frequent distortions and ruptures in the batt as the liquor is blocked by a nonporous belt from passage through the batt in the preferred path normal to the face of the batt.

Second, the pore spaces within a porous belt fabric fill with a portion of the rinsing or treating liquor which is expressed from the batt at the squeeze roll nip. Also, the pore spaces or voids between fibers of the batt are fully saturated with liquor, but become relatively small in volume, roughly on the order of 0.40 to 0.60 fractional volume of the total volume occupied by the fiber plus the liquid, in the wet compressed batt in the area of the nip between the squeeze rolls. Since many cotton fabrics and nonwoven batts contain an abundance of very fine capillary pore systems within and between the cotton fibers, and since fine capillaries are more highly competitive than coarse capillaries, the fine capillaries present in the cotton fabrics will draw or "rob" liquid from the coarser capillary void spaces which characterize most wire or plastic woven conveyor belts.

Translation of the volume density of water, for example, to various area density values as a function of film thickness is very enlightening in understanding the need for avoiding excessive pore volume capacity of the conveyor belt which passes through the nip of the squeeze rolls. A film of water at a density of 1.0 gram per cubic centimeter will weigh 0.0468 pound per square yard for each 1.0 mil of film thickness. Since 1/16-inch equals 0.0625 inch or 62.5 mils of thickness, a 1/16-inch thick water film will weigh 2.925 pounds per square yard, and corresponds to a wet pickup of 292.5% on the weight of a 16-ounce dry fiber per square yard batt, abbreviated as 292.5% OWF.

A sturdy woven wire conveyor belt can easily carry the equivalent of a 1/16-inch thick film of water within the interstices of the wire belt. Hence the practice of conveying a medium weight (16 oz/sq yd) nonwoven cotton batt between the nip of a pair of high expression squeeze rolls can reduce the aqueous liquor content of a 16 oz/square yard cotton batt down to roughly 80% wet pick-up providing that the cotton batt is passed through the nip of the squeeze rolls without the conveyor belt passing through the nip. However, the equivalency of a 1/16-inch thick water film which would also pass through the nip entrained in such a wire conveyor belt would carry an additional theoretical 292% OWF liquor through the nip rolls to be reabsorbed by the cotton batt immediately downstream of the nip.

Furthermore, experimentally measured data for scoured and bleached cotton fiber batts illustrate the point. Such fiber batts may carry on the order of 10 pounds or more of rinse water per pound (dry basis) of cotton fiber as the wet fiber batt is transported from the rinser to the paired high expression squeeze rolls. If this wet fiber batt passes directly into the nip between the squeeze rolls, without the aid of an auxiliary transfer conveyor belt, the water content is typically reduced to some level of residual wet pickup on the order of 0.8 to 1.3 pounds of liquor per pound of fiber. Using density values of 1.54 grams per cubic centimeter for cellulose and 1.0 grams per cubic centimeter for water, the fractional component volumes of air, water and cellulose fiber in the wet cotton batt discharged from the nip of the paired high expression squeeze rolls may be calculated on the basis of the measured wet and dry batt area density values and the thickness of the wet batt. For example, typical values for component fractional volumes are on the order of 0.10 for the dry cellulose of the cotton fiber, 0.20 for the water content in the wet cotton batt, and 0.70 for the fraction volume of air present due to the expansion of the fiber batt after leaving the high compression nip. The 0.10 volume fraction at a density of 1.54 gram per cubic centimeter corresponds to 0.154 gram for the cellulose of cotton fiber. The 0.20 volume fraction of water at a density of 1.0 gram per cubic centimeter corresponds to 0.20 gram of water, equivalent to 1.30 pound of water per pound of dry fiber. If all of the remaining 0.70 volume fraction filled with air is capable of absorbing water from the saturated conveyor belt, an additional wet pickup capacity of 4.54 pounds water per pound of dry fiber is possible.

Consequently, even a conveyor belt fabric measuring only 50 mils thick and characterized by a void volume fraction of, say, 0.60 will contain approximately 1.40 pounds of water per square yard if all of the void spaces are fully saturated, i.e., filled with water. If only 50% of that liquid migrates into a cotton batt containing 16 ounces of dry fiber per square yard, the batt will reabsorb 0.70 pound of water per square yard of batt, equivalent to an increase of 70% in wet pick-up.

It is, therefore, highly desirable to reduce both the thickness and the fraction void volume of conveyor belt fabrics used to convey nonwoven batts through paired squeeze roll nips in order to reduce the total volume capacity of the belt for carrying liquid through the nip. Although tighter weave constructions will reduce fabric void volumes, it is necessary to maintain sufficient open area in the weave pattern to permit the liquors expressed at the squeeze roll to pass easily through the interstices of the fabric weave pattern normal to the plane of the fabric face. Consequently it is preferred to reduce the fabric thickness to reduce the fabric pore volume and also at the same time to reduce the resistance to fluid flow through the belt fabric to facilitate the achievement of criterion (a) for the fiber batt auxiliary transfer conveyor belt.

Thin, light weight woven fabric belts unfortunately lack the stiffness required to maintain the dimensional stability necessary for conventional belt tracking devices such as crowned rolls, belt aligning rolls, fabric edge guides or bumper guides.

Many efforts were made to discover a conveyor belt fabric which could be used to successfully convey the batt through the nip of paired high expression squeeze rolls. Those fabric designs which were considered to be sufficiently dimensionally stable to enable an endless conveyor belt to be self-guiding (or guided by means of conventional arrangements or combinations of centering rolls, crowned turn rolls, etc., well known to those skilled in fabrication and use of such devices) frequently failed to respond to such well known belt tracking arrangements. The passage of the endless transfer belt through the nip of the paired high expression squeeze rolls itself appears to contribute to the tracking problems. Also, an acceptable nip roll transfer belt must be relatively short in length to accommodate the relatively small span length distances between belt turn rolls and auxiliary guiding rolls in the space available adjacent to a conventional paired squeeze roll stand. Such short spans are preferred in the practical economic sense to minimize space requirements, since five or more high expression paired squeeze roll transfer positions are needed, for example, in a simple full scouring and bleaching continuous process for cotton staple.

It is well known that the shorter the belt, the more difficult it is to guide the motion of the belt and keep the belt from tracking off of the center of the belt turn rolls, even with the highly sophisticated automatic belt tracking devices known in the art.

A further complication in the effective employment of conventional belt guiding systems is the fact that the area density of a fiber batt may vary at times from point to point due to an occasional fold, wrinkle, or partial discontinuity in the batt which may occur from time to time in the continuous process. The dominating and controlling driving force applied to the belt is provided by the paired high expression squeeze rolls as the belt (with the superimposed batt) passes through the nip between the squeeze rolls. Consequently, this combination of circumstances may also significantly interfere with conventional belt guiding systems.

And furthermore, when either lightweight, fine textured conveyor belt fabrics, or thin gage more open mesh fabrics were employed with conventional belt guiding aids, the fabrics were more prone to skew, bow, and neck-in within a relatively short period of use. Stretching of the fabric may occur with crowned rolls, defeating the purpose of the crowned roll. If all of the belt guiding turn rolls are not in perfect alignment and true in diameter and concentricity, or if manually or automatically adjusted pivoting turn rolls or guiding rolls are used, the warp and filling yarns (normally oriented perpendicular to each other in the fabric weave pattern) begin to form skewed patterns, i.e., to lose the rectangular orientation between warp and filling yarns. In this manner, a rectangular weave pattern may shift to non-rectangular parallelograms or S-shaped weave patterns. Hence, the fabric becomes progressively narrower in width. The loss in belt fabric working width is in itself highly undesirable. And the shifting weave patterns, loss of the original rectangular belt dimensions and length to width relationships combine to overcome and render ineffective the conventional arts employed to guide endless conveyor belts.

Accordingly, it is an object of the present invention to provide a method and an apparatus for expressing liquor from nonwoven batts in a manner which will limit distortion and prevent rupturing of the batt.

It is a further object of the present invention to provide smooth and uninterrupted transfer of the fiber batt from one impregnator or rinser primary conveyor belt, as the batt passes through the nip of paired high expression squeeze rolls, to the next primary conveyor belt in a subsequent fiber treating vessel or stage.

Another object of the present invention is to provide a method and apparatus which will assure high liquor expression efficiency from the batt so as to facilitate further processing of the batt.

Yet another object of the present invention is to provide auxiliary conveyor belt systems of improved design which will convey the fiber batt through the nip of the paired squeeze rolls and which will permit a more favorable removal of expressed liquor away from the batt than is possible with the presently known conveyor belts and associated guiding devices.

These and other objects of the present invention are realized in various embodiments by utilizing preferred auxiliary transfer conveyor belt fabric designs and guiding devices in conjunction with a pair of high expression squeeze rolls to minimize distortion and rupturing of the batt while maintaining high squeeze roll liquor expression efficiencies.

According to a preferred embodiment of the present invention, the pair of high expression squeeze rolls are arranged with their axes oriented horizontally in a vertical plane and with an auxiliary transfer conveyor belt of suitable fabric design and suitable belt guiding means arranged so as to squeeze the batt at a point along the circumference of the upper squeeze roll significantly above a horizontal plane passing through the nip of the paired high expression squeeze rolls, and then to convey the batt through the nip of the paired high expression squeeze rolls.

According to another preferred embodiment of the present invention, the auxiliary transfer conveyor belt is provided with a pair of guiding chains connected to the belt along the selvedges of the belt. Various sprockets and grooved pulleys, in turn, guide the chains and accordingly align the conveyor belt through the nip and over the various turn rolls.

If desired, a pair of sprockets locked to a common shaft may also be utilized to maintain a preferred alignment of the belt and chains. A torque assist may be provided such as a pair of sprockets (locked to a common shaft) to selectively advance both of the guiding chains simultaneously relative to the belt. Various tensioning mechanisms may be provided to tension either the belt, both chains or selectively only one or the other chain as desired.

BRIEF DESCRIPTION OF THE DRAWINGS

In order to more easily understand the present invention, reference is made to the accompanying drawings wherein like members bear like reference numerals and wherein.

DETAILED DESCRIPTON OF THE PREFERRED EMBODIMENTS

Figure 1:
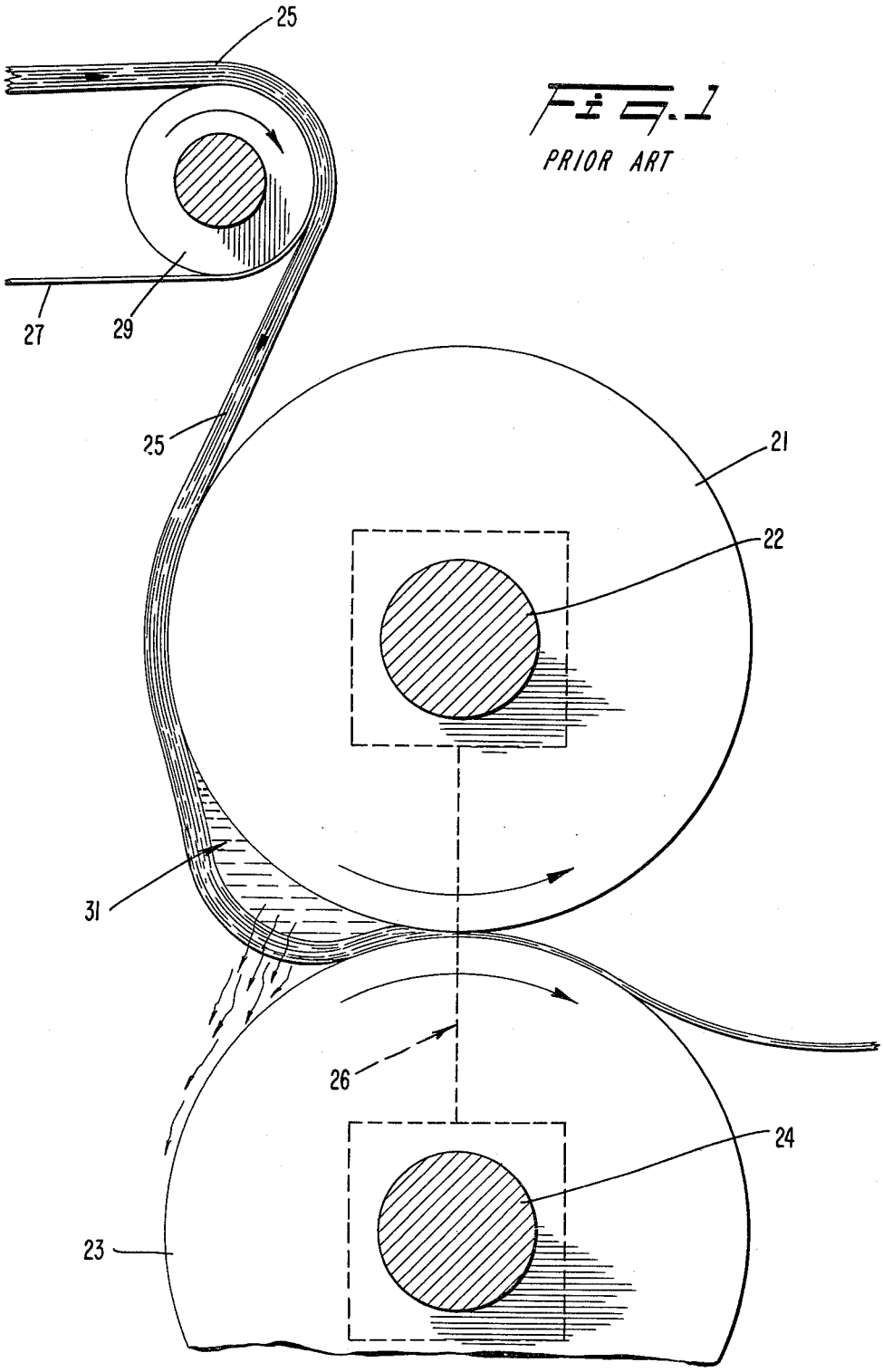
FIG. 1 PRIOR ART
FIG. 1 is a side view of a conventional prior art device including a pair of high expression squeeze rolls providing a nip for a nonwoven fiber batt.

With reference to FIG. 1, a conventionally known arrangement of squeeze rolls includes upper and lower high expression squeeze rolls 21, 23 which are disposed on respective shafts 22, 24 with the axes arranged parallel to one another in a vertical plane. The upper squeeze roll 21 rotates in a counter clockwise direction while the lower squeeze roll 23 rotates in a clockwise direction. A batt 25, saturated with a treating liquor, is fed to a nip between the squeeze rolls 21, 23 from a conveyor comprising a roller 29 and an endless conveyor belt 27. The pressure between the two squeeze rolls may be adjusted by a conventional apparatus (shown schematically in dashed lines and generally indicated by reference numeral 26 in the drawing figure) so as to accommodate different batt materials or thicknesses.

As illustrated in FIG. 1, all of the liquor to be expressed from the batt 25 must be expressed at the nip between the high expression squeeze rolls 21, 23. As the batt 25 enters the nip, roughly half of the expressed liquor passes from the lower side of the batt 25 directly onto the cylindrical surface of the lower squeeze roll 23 and thence to a drain or liquor recirculation system (not illustrated). However, a large portion of the liquor being expressed at the nip is squeezed out of the upper side of the batt. This portion of the expressed liquor builds up between the top face of the batt and the cylindrical surface of the upper high expression squeeze roll 21, forming a relatively large lake of liquor 31. A portion of the liquor in the lake 31 passes directly through the batt 25 to the drain as shown by arrows on FIG. 1. Additionally, a portion of the liquor will pass to the drain by flowing axially along the upper squeeze roll 21 to beyond the selvedge of the batt 25. As the volume of liquor becomes larger and larger in the lake 31, hydrostatic and hydrodynamic forces build up, pressing against the batt. The larger the rate at which expressed liquor builds up in the lake 31, the greater the forces for distorting and rupturing the batt as the batt approaches the nip position.

Figure 2:
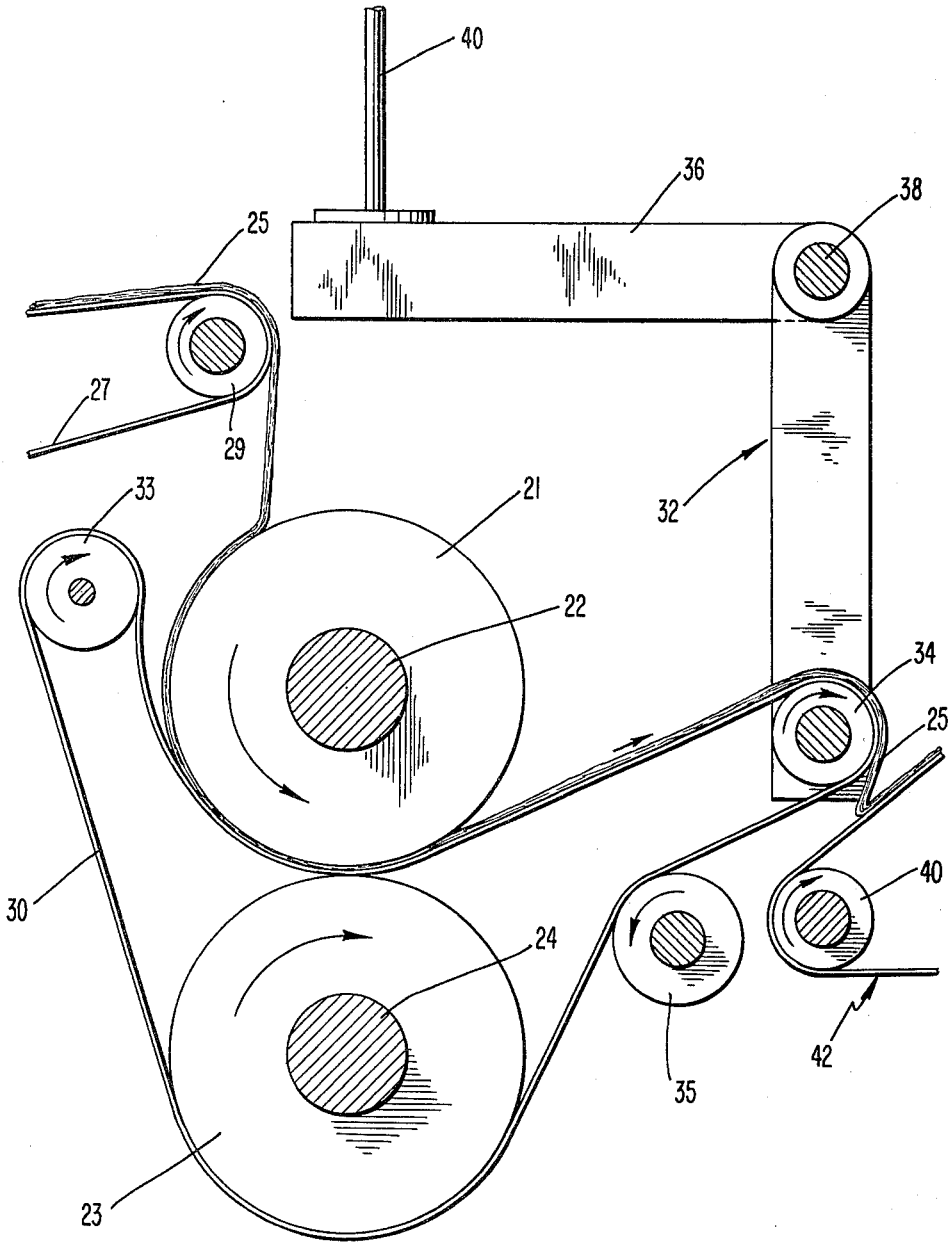
FIG. 2 is a side view of a first preferred embodiment according to the present invention including a pair of high expression squeeze rolls with an auxiliary transfer conveyor belt passing through the nip with the nonwoven fiber batt.

A first preferred embodiment of apparatus according to the present invention, with reference to FIG. 2, includes upper and lower squeeze rolls 21, 23 arranged on respective parallel axes 22, 24. The squeeze rolls extend horizontally with the upper roll 21 arranged vertically above the lower roll 23. A batt 25 is supplied by an endless belt 27 which is carried by a roller 29 to a position generally vertically above the upper squeeze roll 21.

An auxiliary transfer conveyor belt 30 is provided to transport the batt 25 between the nip of the squeeze rolls 21, 23. The conveyor belt 30 passes sequentially over a first turn roll 33, through the nip of the squeeze rolls 21, 23, then around a second turn roll 34. The belt next passes over a third turn roll 35, then beneath the lower squeeze roll 23 and back to the first turn roll 33. Either one or both of the first and second turn rolls 33, 34 may be crowned.

The third turn roll 35 is preferably a conventional, automatically adjusting guide roll having an axis which pivots about a longitudinal mid point of the turn roll 35 to assist in guiding the travel of the belt 30. In such an arrangement, the first and second turn rolls 33, 34 need not be crowned.

The first turn roll 33, as shown in FIG. 2, has a small diameter relative to the diameter of the squeeze rolls 21, 23 and is arranged to rotate clockwise on a shaft alongside the upper squeeze roll 21. In this way, the conveyor belt 30 and the upper roll 21 form a nip therebetween along the circumference of the upper squeeze roll 21 which preferably presses the batt 25 against a portion of the circumference of the upper squeeze roll 21 over a significant portion of the lower left quadrant as illustrated in FIG. 2. The angle subtended by the nip area between the conveyor belt 30 and the upper squeeze roll 21 should preferably exceed about 15°, and more preferably exceed 45°. This angle is measured between the radius drawn from the axis of the upper squeeze roll 21 and the nip between the squeeze rolls 21, 23, and the radius drawn from the axis of the upper squeeze roll 21 and the point of tangency between the conveyor belt 30 and the squeeze roll 21 as the belt passes from the first turn roll 33 to the squeeze roll 21. This angle is preferably about 45° or more, but less than 180°.

In other words, the first turn roll 33 is preferably disposed a short distance from the circumference of the upper squeeze roll 21 directly opposite the third or fourth quadrant of the upper squeeze roll 21 (as shown in the figure). The preferred positioning of the first turn roll 33 depends in part on the diameter of the roll 33 relative to the diameter of the upper squeeze roll 21 and the objective of forming a sufficiently large nip area between the auxiliary conveyor belt 30 and the upper squeeze roll 21. The first turn roll 33 could alternatively be arranged opposite the first quadrant or the second quadrant of the upper squeeze roll if the batt were fed from right to left in the drawing.

The conveyor belt 30 is therefore arranged alongside the surface of the upper squeeze roll 21 to provide a relatively large nipping pressure area against the batt which provides a relatively large drainage area for expressed liquor to flow through the batt and the conveyor belt fabric in a path normal to the face of the batt and the belt fabric (assuming that the conveyor belt 30 is of a porous fabric). This arrangement also enables the conveyor belt 30 to direct the leading edge of the batt into the nip between the belt 30 and the squeeze roll 21 when the batt 25 is initially conveyed into the system in a manner which is essentially self-threading.

A portion of the liquor expressed from the batt 25 passes through the fabric of the conveyor belt 30 as the batt 25 is pressed between the belt 30 and the upper squeeze roll 21. An important advantage in this arrangement is the fact that the pressure increases gradually as the batt 25 advances into the pressure nip formed between the belt 30 and the upper squeeze roll 21, thereby allowing relatively more time and more drainage area (than in the known arrangement of FIG. 1) for a portion of the liquor to be expressed prior to passage of the batt through the nip of the squeeze rolls 21, 23. Another portion of the liquor is ultimately expressed from the batt 25 under the much higher nip pressure applied at the nip between the high expression squeeze rolls 21, 23. In this manner, the fiber formation of the batt 25 remains relatively undisturbed since the conveyor belt 30 in cooperation with the upper squeeze roll 21 begins to grip the batt to prevent distortion and rupture of the batt 25 before large disruptive liquor expression flow rates are initiated.

The extent to which the conveyor belt 30 wraps around the upper squeeze roll 21 in the 3rd (and possibly 4th) quadrant determines the time and the area available for the gradual removal of liquor to be expressed from the batt at the nip stand. If the extent of overlap between the belt and the upper roll 21 is too small, the time and the area for expressing liquor prior to passage of the batt 25 through the nip of the rolls may be insufficient. For example, at high linear speeds of belt travel, if the belt 30 approaches the nip between squeeze rolls 21 and 23 at too shallow an angle, i.e., at an angle approaching a horizontal approach, the copious volume rate of liquor flow per unit area expressed from the batt 25 will tend to be significantly larger and to flow in path patterns generally horizontal to the surface of the batt in a manner which will disturb, disrupt and rupture the batt formation. By increasing the angle by which the belt 30 conveys the batt 25 as it approaches the nip between the squeeze rolls, the liquor may be expressed over a relatively longer period of time and over a relatively greater drainage area in a path normal both to the batt face and to the belt fabric face enabling the conveyor belt 30 to cooperate more effectively with the upper squeeze roll 21 to grip the batt and to prevent distortion and rupturing of the batt.

Figure 3:
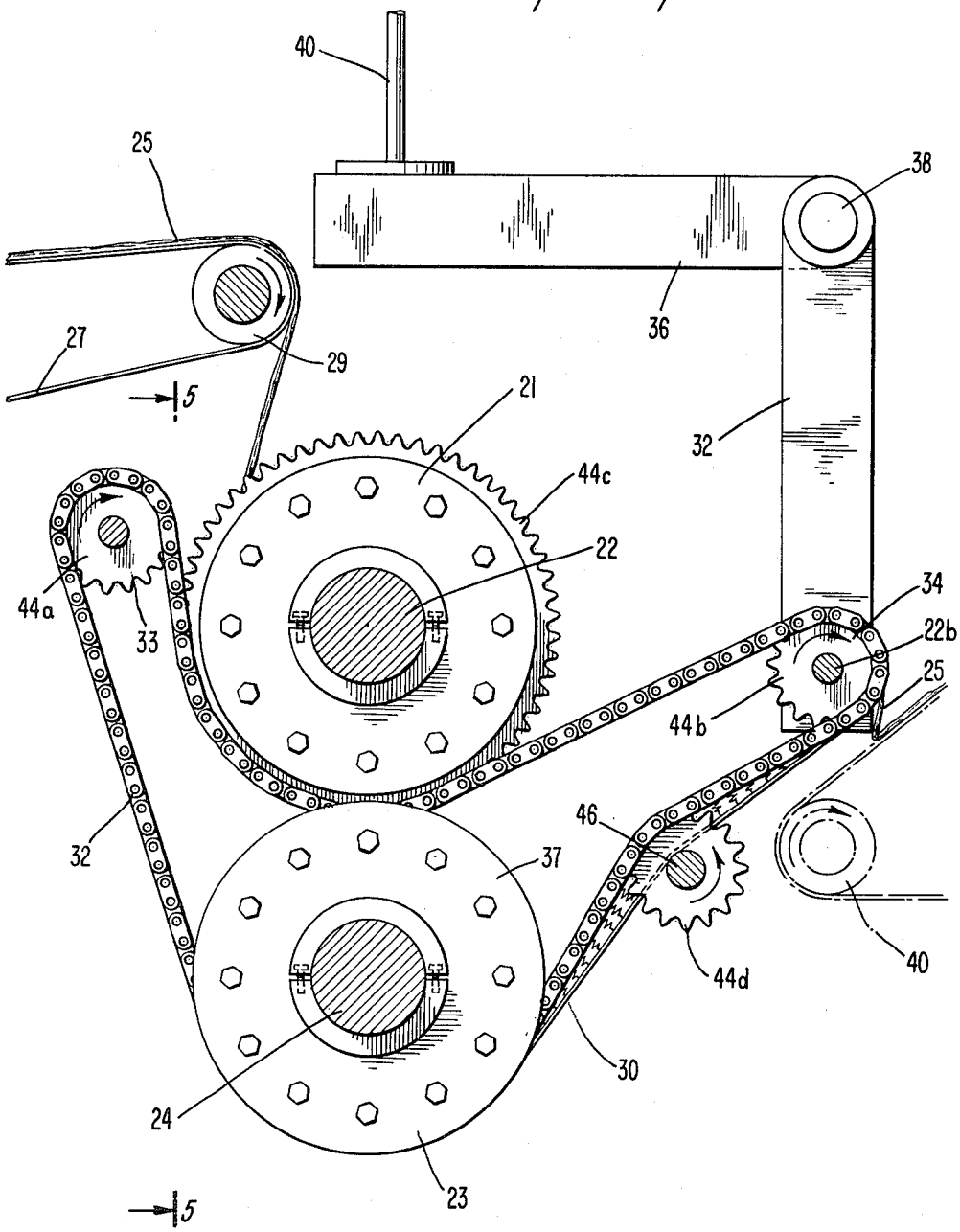
FIG. 3 is a side view of a second preferred embodiment according to the present invention.
Figure 4:
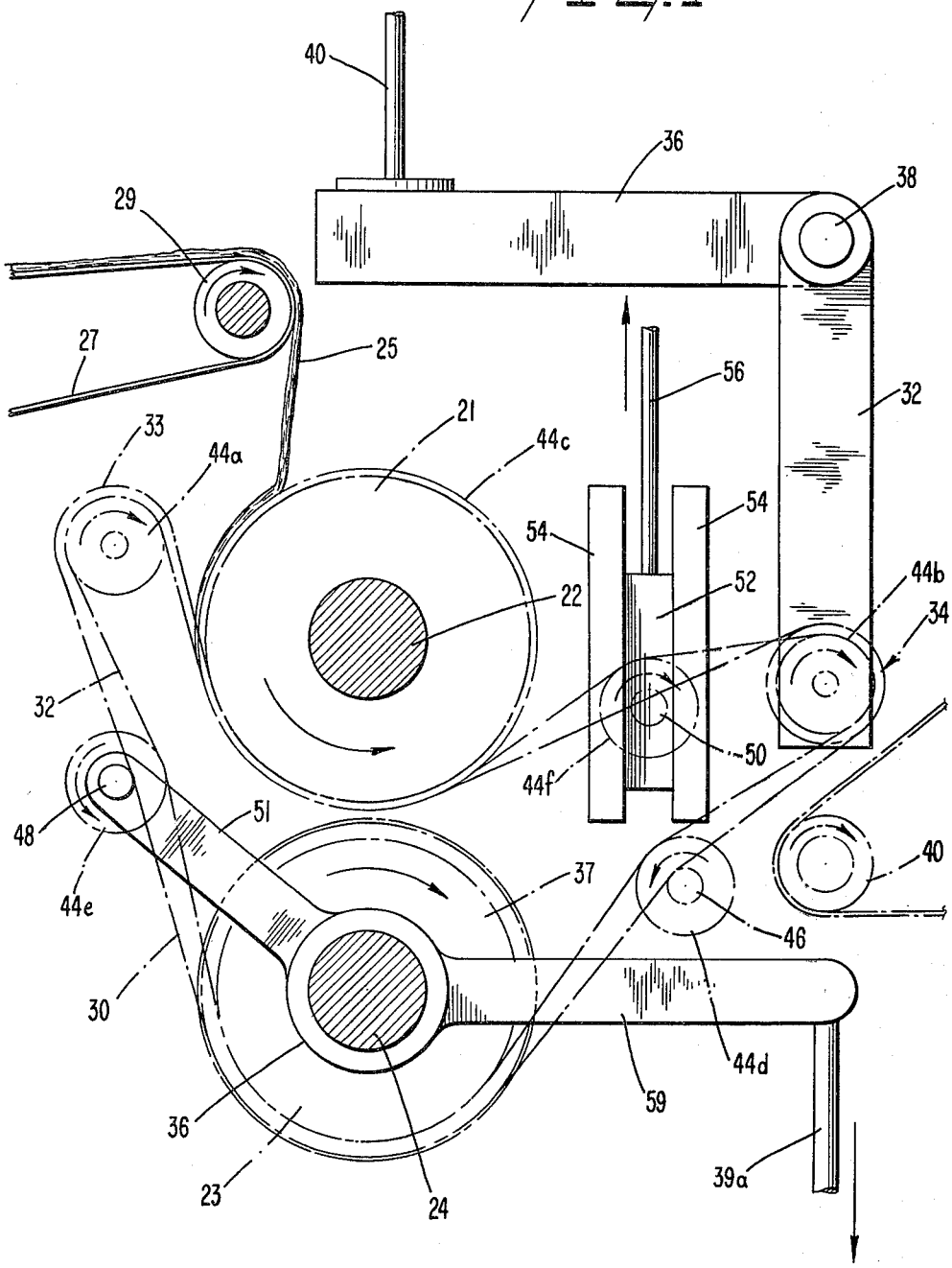
FIG. 4 is a side view of a third preferred embodiment according to the present invention.

In summary, it is preferred that the auxiliary conveyor belt 30 approach the upper squeeze roll 21 at a predetermined angle relative to a horizontal plane passing through the nip of paired vertical squeeze rolls 21, 23. The angle of the approach determines, in part, the area of the pressure nip between the conveyor belt 30 and the upper squeeze roll 21. It is intended to provide a sufficiently large nip area here for a partial expression of treating liquor from the batt prior to the entrance of the batt, superimposed on the auxiliary conveyor belt, into the nip formed by the paired high expression squeeze rolls 21, 23. The position of first turn roll 33 relative to either the axis of the upper squeeze roll 21 or the nip point (tangent line of a horizontal plane passing through the nip between squeeze rolls 21, 23) depends upon the diameter of the first turn roll 33 relative to the upper squeeze roll 21. A typical ratio of the upper squeeze roll 21 diameter divided by the first turn roll 33 diameter in FIGS. 2, 3 and 4 is roughly 3.5/1. Also satisfactory are diameters measuring approximately 9.5 inches and 3.25 inches respectively corresponding to a ratio value of roughly 3/1. Under these circumstances of relative diameters, the positioning of the first turn roll 33 relative to the upper squeeze roll 21 as depicted in FIGS. 2, 3 and 4 provides a sufficiently large angle subtended by the nip area between the conveyor belt 30 and the upper squeeze roll 21.

Although it is economically preferable to use a smaller diameter roll 33 as shown in FIGS. 2, 3 and 4, one could substitute a relatively large diameter first turn roll 33 for the smaller diameter first turn roll pictured in FIGS. 2, 3 and 4. If, for example, the first turn roll 33 were equal in diameter to that of the upper squeeze roll 21, then the first turn roll 33 could be positioned with its axis significantly lower than that depicted in FIGS. 2, 3 and 4, and still satisfy our ultimate objective as discussed above.

To selectively tension the belt 30 the second turn roll 34 may be mounted on an arm 32. Alternatively, the first turn roll 33 may preferably be mounted on an arm to selectively tension the belt 30 (not shown).

The arm 32 is rigidly connected to an arm 36 for movement about a pivot 38. An appropriate tensioning mechanism such as an extensible rod 40 is provided to exert a desired force on the arm 36 and thereby pivot the arm 32 away from the rolls 21, 23. In this manner, the turn roll 34 may be selectively urged away from the squeeze rolls 21, 23 to appropriately tension the belt 30.

Since the belt 30 forms a 180° wrap around each of the turn rolls 33, 34, a small movement of either roll, in a direction parallel to the linear travel of the belt 30 as it approaches either turn roll 33 or 34, provides a significant take-up of belt fabric slack. With the turn roll 34 positioned for a 180° wrap as displayed in FIG. 2, a movement of one inch in the roll 34 position (in a direction parallel to the linear travel direction of the belt 30 as it approaches the turn roll) will take up two inches of slack. Tension is then shared equally by each segment of the belt 30 approaching or departing the take-up tensioning turn roll 34. Hence, if an 80-pound force is applied in such a manner to the roll 33, for example, the belt segment approaching the roll 33 will experience a 40-pound tensioning force. Likewise, the belt 30 segment departing the roll 33 will experience a 40-pound tensioning force (assuming that the turn roll 33 is free to rotate on low friction bearings). Hence such a configuration, which favors a 180° wrap, is generally preferred for maximum fabric slack take-up capacity and minimum tensioning stress on the fabric.

If the angle of fabric wrap is less than 180°, then the tensioning force applied to the fabric will increase in accordance with the well known force vector relationships inherent in such angular dispositions. Also, the amount of belt slack take-up for a given displacement of the take-up roll will diminish as the angle of belt wrap decreases from 180°. The geometric relationships for take-up tensioning roll movements relative to belt slack take-up and resultant force vectors are well known and are recited here merely to provide insights relative to various preferred embodiments of the invention.

As a matter of convenience for installation access, the turn roll 34 may likely be selected to serve as the belt fabric take-up roll. However, it should be noted that the need to minimize a slack condition in the conveyor belt fabric is greatest in the fabric segment between the turn roll 33 and the nip between the high expression squeeze rolls 21, 23. Consequently, if the cumulative frictional drag resistance of the second and third turn rolls 34, 35 and the lower surface of the lower squeeze roll 23 is sufficiently high to significantly diminish the tension force applied to the belt 30 as it passes around the second and third turn rolls 34, 35 and under the lower roll 23, it then becomes preferable to select the turn roll 33 to serve as the belt fabric take-up roll. With the fabric take-up tension applied directly by the roll 33, the tension required to take up the slack (in the belt segment between the roll 33 and the high expression nip between the rolls 21, 23) is more effectively translated directly to that segment of the conveyor belt fabric which must remain taut in a non-slack condition. For example, if the frictional resistance between the belt fabric and the lower surface of the squeeze roll 23 is sufficiently high to block the belt take-up tension applied at the turn roll 34 from extending on around to the belt segment between the turn roll 33 and the squeeze roll 21, then it is preferable to apply the fabric take-up tension force via movement of the first turn roll 33.

Consequently, in summary, a more highly preferred embodiment of this invention utilizes a belt take-up turn roll position which (a) favors a 180° belt wrap configuration, and which (b) favors the full utilization of the applied belt take-up tension to be experienced in the belt segment immediately upstream of the nip of the high expression squeeze rolls, i.e., between the first turn roll 33 and the nip of the squeeze rolls 21, 23 of FIGS. 2, 3, and 4. In this manner, maximum belt slack take-up capacity is provided by a given movement of the belt take-up turn roll, and, also the tension applied to the fabric is minimized, i.e., the fabric tension need not exceed that required to remove the belt slack between the first turn roll 33 and the nip of the squeeze rolls 21, 23. However, the embodiment in which the conveyor belt fabric tension roll is positioned as shown for roll 34 in FIGS. 2, 3 and 4 is, under a number of less critical process conditions, an embodiment alternative which can be successfully employed.

After the batt 25 passes through the nip of the squeeze rolls 21, 23 and over the turn roll 34, the batt 25 is transferred to a second primary conveyor belt 42 which travels about a turn roll 40. The batt may then proceed to another stage in the batt treatment process.

With reference now to FIG. 3, a second preferred embodiment of the present invention differs from the embodiment of FIG. 2 in that the belt 30 is provided with endless chains 32 along each edge of the belt 30 to guide the selvedges of the conveyor belt fabric and in order to prevent the belt from tracking off center in its endless path around the first and second turn rolls 33, 34 and the squeeze rolls 21, 23. The selvedge guiding chains 32 are attached to the selvedges of the conveyor belt 30 by lacings, ties, or springs, (see FIG. 5). First and second pairs of chain guiding sprockets **44*a* and 44*b* are mounted on either end of the first and second turn rolls 33, 34 respectively so as to "free wheel". However, it is also often times found to be necessary to add a pair of sprockets 44*c* of pitch diameter closely approximating that of the upper squeeze roll 21 to the shaft 22 (in a free wheeling manner) to force the chains to follow a path closely approximating that of the belt fabric around the lower quadrants of the upper squeeze roll 21. Likewise a pair of pulleys 37 of pitch diameter closely approximating that of lower squeeze roll 23 are provided to force the chains to follow a path closely approximating that of the belt fabric around the lower quadrants of the lower squeeze roll 23**.

Figure 5:
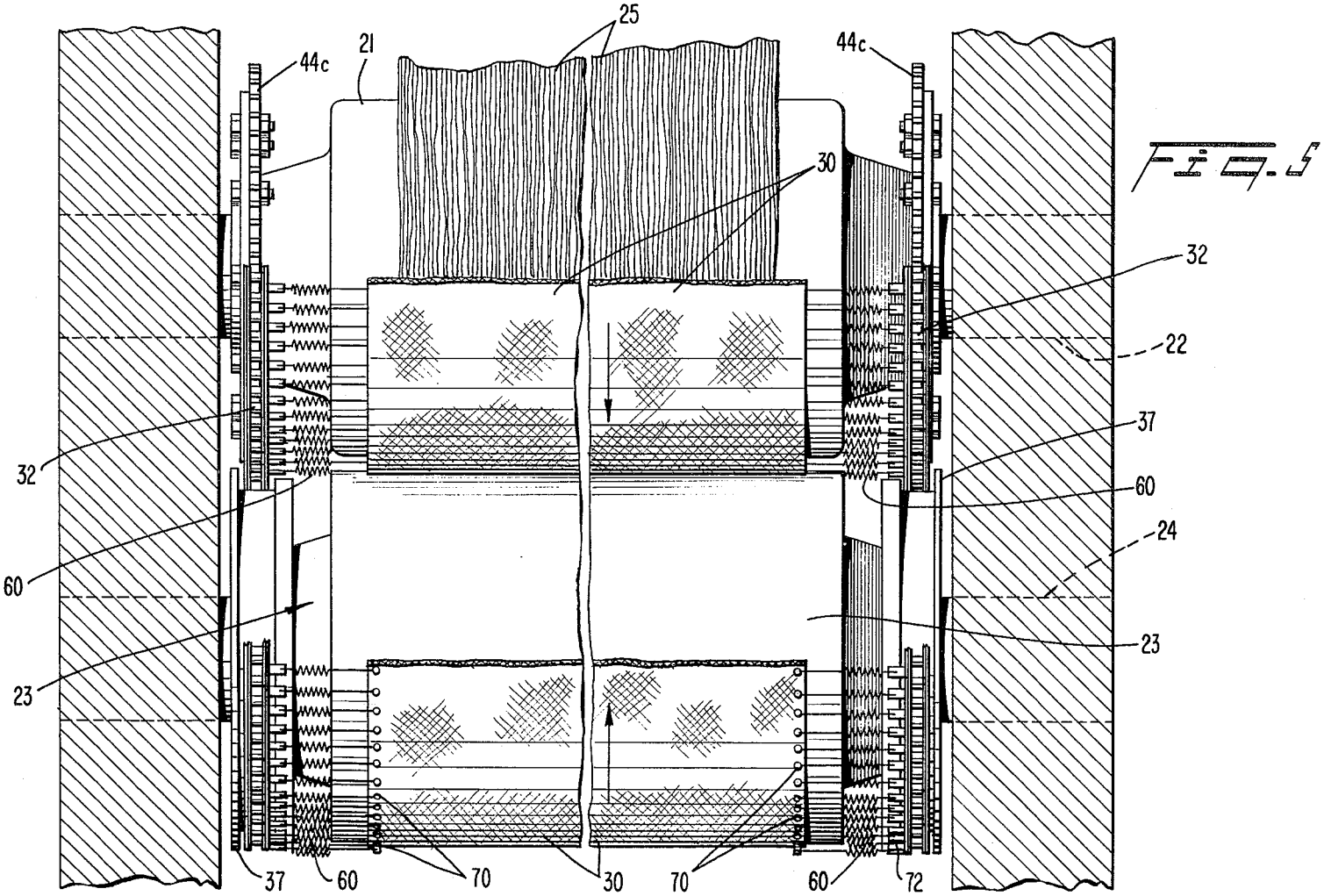
FIG. 5 is a view through the line 5—5 of FIG. 3.

It is preferable to mount the sprocket **44*c* directly above the cooperating pulley 37 on each end of the squeeze rolls in a manner which would not cause or necessitate the chain to deviate significantly from a path of travel in a common vertical plane perpendicular to the axes of the squeeze rolls 21, 23 and the associated shafts 22, 24. Consequently the pitch diameter of the sprocket 44*c* was first set to approximate that of the squeeze roll 21 diameter, with due allowance for the resulting pitch diameter of the chain attachment brackets. With reference to FIG. 5, each spring is attached to an associated bracket on the guiding chain. It is desirable that the pitch diameter of the path through which the belt fabric-attaching-springs (or lacing ties) passes approximates the diameter of the upper squeeze roll 21. In this manner less stressing and wear are experienced by the springs or ties connecting the conveyor belt fabric 30 to the guiding chain 32**.

The diameter of the cooperating pulley 37 must therefore be reduced sufficiently to provide proper clearance for the chain 32 to pass unhindered while engaged in the teeth of the sprocket **44*c*. However, keeping this restraint in mind, the diameter of the cooperating pulley 37 should not be excessively reduced below that of the diameter of the lower squeeze roll 23, again to avoid excessive stresses and wear of the springs or ties connecting the belt fabric to the guiding chain as the chain 32 is guided by the pulley 37 under the squeeze roll 23**.

It is preferable, but not essential, to groove the pulley 37 in some manner as depicted in FIG. 5 to assist in guiding the chain with the object of preventing the chain from moving excessively in the lateral direction parallel to the axis of roll 23.

Since it is not economically practical to match precisely the effective pitch diameter of the sprocket **44*c* to that of the squeeze roll 21, it is preferable to mount the sprockets 44*c* on the shaft 22 in a manner which enables the sprockets 44*c* to rotate independently of the speed of the shaft 22 during rotation, that is, in a manner referred to as free wheeling. Otherwise, the small differences in linear speed of the chain and the surface of the squeeze rolls 21, 23** would generate excessive stresses and wear on the conveyor belt fabric, roll surfaces, guiding chains and connecting springs or ties.

It is also preferable to mount the cooperating pulleys 37 in a free wheeling manner to minimize wear and tear of the component parts in the conveyor belt system under discussion. However, since the pulley 37 may be fabricated from low friction wear resistant materials, the pulleys may be locked either to the shaft 24 or to the lower squeeze roll 23, in which case the chain 32 will slide over the surface of the pulley to accommodate the small differential in surface speeds.

In summary, with reference again to FIG. 3 in the second embodiment of this invention, each selvedge of the auxiliary conveyor belt 30 is attached to the selvedge guiding chain by springs, laces, or other suitable connectors to restrain the belt fabric from tracking excessively off center from the belt turn rolls and squeeze rolls. The selvedge guiding endless chains, in turn, are guided by the paired sprockets **44*a*, 44*b* and 44*c* which cooperate with the cooperating pulley 37 to travel in a path closely following the path pattern traversed by the endless conveyor belt fabric. The teeth of the sprockets 44*a*, 44*b* and 44*c* also provide a resistance to lateral deflection perpendicular to the direction of travel of the conveyor belt 30, thereby preventing excessive movement of the conveyor belt away from the desired central tracking position. To reduce the tendency for the cross machine direction stresses to deflect the guiding chain sufficiently to cause the chain to jump off one or more of the sprockets, the pulley 37 may be grooved as illustrated in FIG. 5** to help the guide chain resist lateral, cross machine direction (CMD) deflection.

A third embodiment according to the present invention, with continued reference to FIG. 3 includes the addition of a pair of sprockets 44*d* which are mounted on a single shaft 46, both sprockets 44*d* being locked into fixed positions relative to the shaft 46. The shaft 46 is positioned at a point roughly midway between one of the conveyor belt fabric turn rolls and one of the squeeze rolls, for example, roughly midway between the second turn roll 34 and the lower squeeze roll 23 as shown in FIG. 3 in a position to effectively engage the teeth of the paired sprockets 44*d* with the paired chains 32. By keying or locking the rotation of both of the paired sprockets 44*d* to shaft 46, each of the paired selvedge guiding chains 32 is locked into synchronized linear travel speed with the opposite chain. Consequently, the locked sprocket pair 44*d* rotating on the shaft 46 will impose a restraining force translated through the synchronized guiding chains 32 to the selvedges of the conveyor belt fabric in a manner to prevent skewing of the conveyor belt fabric weave pattern. This arrangement significantly helps to maintain a long term belt tracking integrity for the system, increases wear life of the conveyor belt system, and facilitates the application and use of a fourth embodiment of our invention.

In the embodiment of FIG. 3, the paired sprockets 44*d*, locked to the shaft 46, replace the third turn roll 35 of the embodiment of FIG. 2.

It should be noted that any one pair of the sprockets may be mounted on a common shaft and locked into fixed positions on the common shaft in order to synchronize the movement of each selvedge guiding chain, the one chain and sprocket being in fixed relation to the other chain and sprocket. However, if the paired sprockets are locked to a common shaft which also supports a fabric turn roll, then the turn roll should be free to rotate on the shaft in a free wheeling manner, that is, free to rotate at an angular velocity different from the angular velocity of the shaft and associated locked pair of sprockets.

In any case where a given pair of sprockets is locked to the rotational angular speed of a shaft which also supports either a fabric turn roll or a squeeze roll, it is essential that the roll on that shaft be free to rotate independently of the angular speed of the sprocket in order to accommodate the differential in surface speed of the conveyor belt fabric and the roll surface speed. Any mismatch between the effective pitch diameter of the path through which connecting springs travel and that of the fabric travel path will result in an undesirable increase in wear and tear on the conveyor belt fabric, the connecting ties or springs, and the guiding chains if the fabric turn rolls are not free to rotate at an angular speed which differs from that of the associated sprockets.

A fourth preferred embodiment according to the present invention may be better understood by first describing the forces and relative responsive movements of the various belt fabric turn rolls, the squeeze rolls, the auxiliary conveyor belt 30, the selvedge guiding chains 32 and the springs attaching the selvedges of the conveyor belt fabric to the guiding chains 32. In the total system consisting of the paired squeeze rolls mounted vertically one over the other, in what is referred to as a vertical nip roll stand, and to which has been added an auxiliary conveyor belt system as described for the embodiments of FIG. 3, one primary driving force may be applied to turn the various rolls and to drive the conveyor belt.

Preferably, the primary power source is applied to turn one or both, but preferably only one, of the high expression squeeze rolls. Generally, as a matter of convenience and practicality, the lower squeeze roll is driven through appropriate gearing by an electric motor (not shown). The upper squeeze roll then turns freely in response to the frictional driving force from the lower squeeze roll as transferred through the auxiliary transfer conveyor belt 30 and the superimposed fiber batt 25. The conveyor belt fabric is therefore driven through the nip between the squeeze rolls, under these circumstances, by the lower squeeze roll. The conveyor belt fabric in turn pulls the selvedge guide chains by means of the connectors or springs shown in FIG. 5. The guiding chains therefore turn the various free wheeling and locked sprockets described in the second and third embodiments of the invention (see FIG. 3).

Consequently, the resultant force vectors applied by the conveyor belt fabric selvedges to the guiding chains may be resolved into two force vectors. One force vector may be considered as being directed parallel with the path through which the endless conveyor belt and endless guiding chains travel. The second force vector may be considered as being directed perpendicular to the first force vector, and hence essentially in the cross machine direction (CMD). If the connecting ties or springs are of the proper length in relation to the belt fabric width and chain positions, and if the conveyor belt fabric is centered with respect to the guiding chains, there is little or no CMD force vector exerted on either the fabric selvedges, the tie springs, or the guiding chains while the belt rolls are motionless. Then as the lower squeeze roll begins to turn, the belt begins to move applying a pulling force vectored parallel to the guiding chain path of motion, thereby overcoming the summation of the equal and opposing frictional drag forces of the free wheeling and locked sprockets and the cooperating pulleys. The inherent flexibility of connecting springs or lacing ties results in a herring bone alignment of the ties connecting the chains to the fabric selvedges as the belt fabric pulls the chains forward.

As a result, CMD force vectors develop which tend to stretch the fabric outwardly in the CM direction and also to deflect the selvedge guiding chains laterally and inwardly in the CMD. If the conveyor belt tends to track off center, an additional CMD tension vector will be automatically added to the existing CMD vector on one of the selvedge guiding chains. The added CMD force vector will tend to correct and overcome the tendency of the belt fabric to move off center. However, if the combined sum of the CMD force vectors due to (a) the frictional drag of the chain and sprocket system and the connecting tie geometry and force vector angles, and due to (b) the tendency of the belt fabric to track off center become sufficiently large, the horizontal deflection of the guiding chain increases in the CMD, and the chain is more likely to ride up on the sprocket teeth and be pulled off of the sprocket.

Consequently, a small torque driving assist, for example a small variable electrical torque drive, may be added as the fourth embodiment to this invention to provide a portion of the driving force to overcome the frictional resistances or drag of the chain guiding system. This variable torque driving assist is readily applied by the shaft 46 on which the paired, keyed or locked sprockets 44*d* are mounted. In this manner, any desired amount of assisting driving torque can be applied to the chains to reduce the driving force required to be supplied to the chains by the conveyor belt fabric.

The assisting driving torque may be applied to the selvedge guiding chains by any one sprocket or any one pair of sprockets locked to a shaft driven by the small variable electric torque drive motor. However, it is essential that the paired guiding chains be locked into fixed relationship to each other by at least one pair of sprockets locked to a common shaft as previously described in the third embodiment. It is preferable to apply the assisting torque to a pair of sprockets locked to a common shaft, and it is convenient in our existing equipment to apply the torque by the shaft 46 as shown in FIGS. 3 and 4.

A fifth preferred embodiment of the present invention (see FIG. 3) relates to the tensioning of the conveyor belt fabric by the movement of the turn roll 34 through the lever arm 32. It was found that if the conveyor belt fabric were not held sufficiently taut against the upper squeeze roll 21, then sufficient slack in the belt could develop to permit excessive room for expressed liquor and fiber to accumulate in a pouch-like pattern between the slack belt fabric and the upper squeeze roll 21, in a manner and shape similar to that displayed in FIG. 1. Although the belt fabric under slack conditions prevents the total rupturing of the batt and loss of fiber movement through the nip of the paired squeeze rolls, too much space between a slack belt fabric and the squeeze roll 21 permits a sufficiently large lake of expressed liquor to build up, similar to the lake 31 depicted in FIG. 1, to generate a relatively loose slurry of fibers to tumble and reform in the slack pouch-like confinement space between the belt fabric and the upper squeeze roll. This condition is more likely to occur at higher linear speeds and/or with heavier batt area densities, and also with batts composed of fibers which are characterized as being relatively fine, i.e., of low fiber linear density values.

However, the addition of tension to the conveyor belt fabric often required that sufficient slack be present in the selvedge guiding chains to enable the tensioning swing roll 34 to fully tension the belt fabric 30 without the restraint of the guiding chains 32. If the guiding chains 32 are not sufficiently long or slack, the swing turn roll 34 cannot move sufficiently far to apply the desired tension to the belt fabric. If the guide chains 32 are too long or too slack, they are much more prone to ride up and jump off of the sprockets. Although it is possible to adjust the length of the chains and the belt fabric to precisely the correct lengths to minimize the problems just discussed, such a procedure, to be effective, requires very good dimensional stability of the belt fabric in relation to the guiding chains 32. Woven plastic wire belts are known to stretch under tensions of long duration, or to shrink with heat under low tensions. The steel chain is relatively stable in length.

A sixth preferred embodiment of this invention, with reference to FIG. 4, includes the addition of paired sprockets **44*e* and 44*f* which are provided with appropriate mechanisms for applying independent tensioning forces to the guiding chains 32, without significantly affecting the tension applied to the conveyor belt fabric by the tensioning turn roll 34. In the illustration of FIG. 4, the paired sprockets 44*e* are mounted on a common shaft 48 with a chain take-up tension applied simultaneously to both sprockets 44*e* by a force applied through an arm 39*a* and translated to the shaft 48 by a lever arm 59 pivoted on the shaft 24. The paired sprockets 44*e* may be either free wheeling with respect to the shaft 48, or they may be locked or keyed to the shaft 48** to serve as a locked pair of sprockets.

The pair of sprockets **44*f* differ from the pair of sprockets 44*e* in that each of the sprockets 44*f* is mounted on a separate respective shaft 50. Each shaft 50 is supported in a separate gib arrangement including a gib block 52 supporting the associated shaft 50 for movement up or down in a channel formed by a pair of members 54. The gib block may be moved up and down by way of a tensioning device such as a spring or air pressure acting through a connecting rod 56. Hence just enough tension can be applied independently to either one or both of the paired sprockets 44*f* to prevent the guiding chains 32 from becoming too slack, and without significantly reducing the desired tension level applied to the belt fabric by the tensioning turn roll 34**.

It should be noted of course, that the small take-up tensions applied by the sprockets **44*e* and 44*f* to take up excess slack in the chains 32 will reduce to a small degree the tension applied to the belt 30 by the tensioning turn roll 34. However, the tension applied to the belt 30 by the tensioning turn roll 34 may be sufficiently large, and the tension applied to the chains 32 by the sprockets 44*e* and 44*f* may preferably be sufficiently small, so that the additional chain tension provided by the sprockets 44*e* and 44*f* is relatively small with a relatively insignificant effect on the belt fabric tension while having a significant effect on the tensioning of the chains 32**.

It should also be noted that the positions of the sprockets **44*c* on the shaft 22 and of the cooperating pulleys 37 on the shaft 24 can be reversed if the guiding chain 32 is reversed so that the connecting brackets on the chain are also reversed to accomodate the grooves in the pulleys. However, if this option is elected, then grooved pulleys cannot be substituted for the sprockets at the turn rolls 33 and 34**.

It should be noted that grooved pulleys may be substituted for some of the sprockets to control the path of the guiding chains 32 whenever the sprocket is positioned on the inside of the loop formed by the endless chain and so long as the brackets attached to the chain are positioned on the outside of the loop formed by the endless chain.

Although the present invention provides advantages when used with even a non-porous conveyor belt, it is preferred that only a porous conveyor belt be utilized, so as to readily pass the liquor from the batt. Conventional porous belt fabrics are acceptable although relatively thinner and relatively more densely woven belt fabrics do provide significantly improved results. For example, experimentation indicates that the following fabrics (not conventionally used as conveyor belts) will be desirable for use in the porous conveyor belt of the present invention:

| STYLE # | WEAVE CONST. | FABRIC THICKNESS | WARP PER INCH | PICKS PER INCH | YARN DIAMETER WARP | YARN DIAMETER WEFT |
|---|---|---|---|---|---|---|
| | | Chicopee - Green Nylon | | | | |
| 6025400 | PLAIN | 0.008" | 70 | 74 | 0.005" | 0.005" |
| | | TETCO - Nylon | | | | |
| HC3-150 | PLAIN | 0.0043" | 121 | 121 | 0.0024" | 0.0024" |
| HD3-44 | TWILL | 0.0040" | 194 | 288 | 2 × .0017" | 0.0017" |
| HD3-124 | PLAIN | 0.0091" | 102 | 102 | 0.0048" | 0.0048" |
| | | TETCO - Polypropylene | | | | |
| 5-100-149 | TWILL | 0.0072" | 100 | 100 | 0.0042" | 0.0042" |

-continued

| STYLE # | WEAVE CONST. | FABRIC THICK-NESS | WARP PER INCH | PICKS PER INCH | YARN DIAMETER WARP | YARN DIAMETER WEFT |
|---|---|---|---|---|---|---|
| 5-120-125 | TWILL | 0.0085" | 113 | 113 | 0.0039" | 0.0039" |
| 5-140-105 | TWILL | 0.0086" | 124 | 124 | 0.0039" | 0.0039" |
| 5-74 | TWILL | 0.0077" | 160 | 160 | 0.0033" | 0.0033" |

All of these fabrics appear to be suitable and preferable for use in the present conveyor arrangement since they provide less than about 0.25 pound of liquor per square yard of belt for reabsorption into the batt.

Other tested fabrics appear to be unsuitable because they provide over 0.40 pound of expressed liquor per square yard of belt. This is because the interstitial pore space void volumes of the unsuitable fabric constructions are sufficiently large to adversely affect the squeeze roll expression efficiency. The fabrics having relatively thin construction and a relatively dense weave pattern are believed to be preferable to conventional conveyor belt fabrics because of the amount of liquor which may be carried by the belt through the nip.

The volume of textile processing liquor which may be entrained in the void spaces of the interstices between yarns making up the weave patterns of conveyor belts is of considerable interest and significance among the criteria for selecting conveyor belt fabrics which are intended to convey non-woven webs, batts or fabrics through the nip of high expression squeeze rolls. A large total volume of such interstitial void space per unit area of conveyor belt fabric is generally undesirable since a significant portion of the liquor expressed from the non-woven batt by the squeeze rolls is momentarily retained by the conveyor belt fabric during passing of the belt through the nip. In cases where the non-woven batt formation is such that the void spaces in the interstices between fibers forming the batt are relatively small (i.e. relatively fine pore structures), the liquor momentarily retained in the coarse pore structure of the conveyor belt is reabsorbed back into the structure of the non-woven batt as the batt leaves the nip and expands in volume (much as a compressed sponge absorbes liquid when it is released to expand under water).

With reference to the third through sixth embodiments (see FIG. 5), a series of eyelets 70 are provided adjacent the selvedge of the belt. Springs of suitable length and strength are provided so as to join each selvedge of the belt fabric to a guiding chain. For example, if the belt is 10 feet in length and if the eyelets are spaced 2 inches apart, 60 springs will be provided on each side of the belt for a total of 120 springs. In the stationary configuration of FIG. 5, the springs should exert a minimal tension on the belt in both the machine direction (MD) and cross machine direction (CMD).

Suitably designed end loops on the springs serve to help maintain the engagement of the springs with the eyelets 70 and the brackets 72. In this way, the ends of the springs 60 may be provided with resilient closures so as to minimize the detachment of the springs from the eyelets and brackets even if the spring should become relaxed for example if the chain is removed from the sprockets or if the belt should travel off center toward one of the chains.

The particular design of the connecting springs used with various belts is determined in part by the generally crowded conditions of existing equipment with respect to batt width, belt fabric width, squeeze roll face width, and squeeze roll nip stand frame width. The resultant distance between the belt fabric selvedges and the guiding sprockets 44c and pulleys 37 necessitates the use of relatively short springs. The shorter the spring, however, the less the potential for spring expansion under tension. Hence, the feasibility for pretensioning the springs becomes relatively less reliable since widthwise shrinkage of the conveyor belt fabric is not always predictable. Such shrinkage may occur after the conveyor belt fabric is in place at the nip stand, due either to heat of treating liquors or to tensioning of the fabric in the machine direction. Machine direction tension on the fabric can induce a crimp interchange, in which case the weave crimp of the warp yarn is reduced and the weave crimp of the filling yarn increases.

Since it may not be expedient to widen the distance between the frames upon which the squeeze rolls are mounted on existing equipment, long springs may not be usable to accommodate varying widths of fabric. It therefore may be necessary to arrange the hooks at the ends of the short springs so as to minimize the tendency for the springs, in a slack condition, to become detached from the fastening holes along the selvedges of the conveyor belt fabric.

Of course, with new equipment fabrications, wider distances between the frames upon which the squeeze rolls are mounted are readily feasible. With wider distance between these frames, greater distance may be allocated to the space between the conveyor belt fabric selvedges and the sprockets which carry the guiding chains. This then will permit the use of longer connecting springs with greater latitude for some degree of prestretching of the springs for pretensioning the conveyor belt fabric in the cross machine direction while the belt is motionless. With pretensioned springs, the potential for slack spring conditions to occur is much less likely, and the design of the hooks at the ends of the springs becomes less critical.

If lacings are provided, a suitable, chemically resistant material such as polypropylene yarn, twine, or narrow woven ribbon should be used. If desired, the lacings of each side could be divided into a series of for example 10 lacings so that the entire connection between the chains and the belt is not lost upon the occasional snapping of one lacing.

If individual ties are utilized, the same material as the lacings can be utilized. The springs 60 could be replaced by rigid arms or by flexible chains (not shown). If rigid arms are utilized, it is expected that the arms will be pivotably connected at the eyelets and at the brackets to accommodate relative movement in the machine direction between the belt and the chains.

Although it is generally preferable that the upper surface of the first turn roll 33 be located substantially above the horizontal location of the nip of the squeeze rolls 21, 23 so as to provide a significant pressure area of the batt 25 against the upper roll 21, the first turn roll 33, under special conditions, may also be located so that the belt 30 approaches the nip horizontally or even from below.

For example, there are some conditions of fiber characteristics coupled with batt formation and linear processing speeds of the batt where liquid drainage rates through the batt, perpendicular to the batt face, are sufficiently rapid so that disruption of the batt does not occur even though the conveyor belt fabric conveys the batt in a horizontal direction as the batt approaches the nip of the high expression squeeze rolls. However, the batt would be subject to disruption by the expressed liquor flow rates if the batt were not supported by the auxiliary conveyor belt fabric passing through the nip of the paired high expression squeeze rolls. Hence all of the other embodiments of this invention pertinent to the conveyor belt fabric and the guidance systems for such conveyor belts offer highly significant advantages over the prior art, regardless of the angle of the conveyor belt fabric approach with respect to the nip of the high expression squeeze rolls.

With reference now to FIG. 5, the free wheeling sprockets 44*c* are carried on the shaft 22 of the upper squeeze roll 21, and the pair of cooperating grooved pulleys 37 are rigidly mounted on the shaft 24 of the bottom squeeze roll 23. The selvedge guide chains 32 pass under the upper squeeze roll 21 in a path controlled by the free wheeling sprockets 44*c*. The pair of endless chains 32 is also seen on the return path controlled by the grooved pulleys 37.

Figure 6:
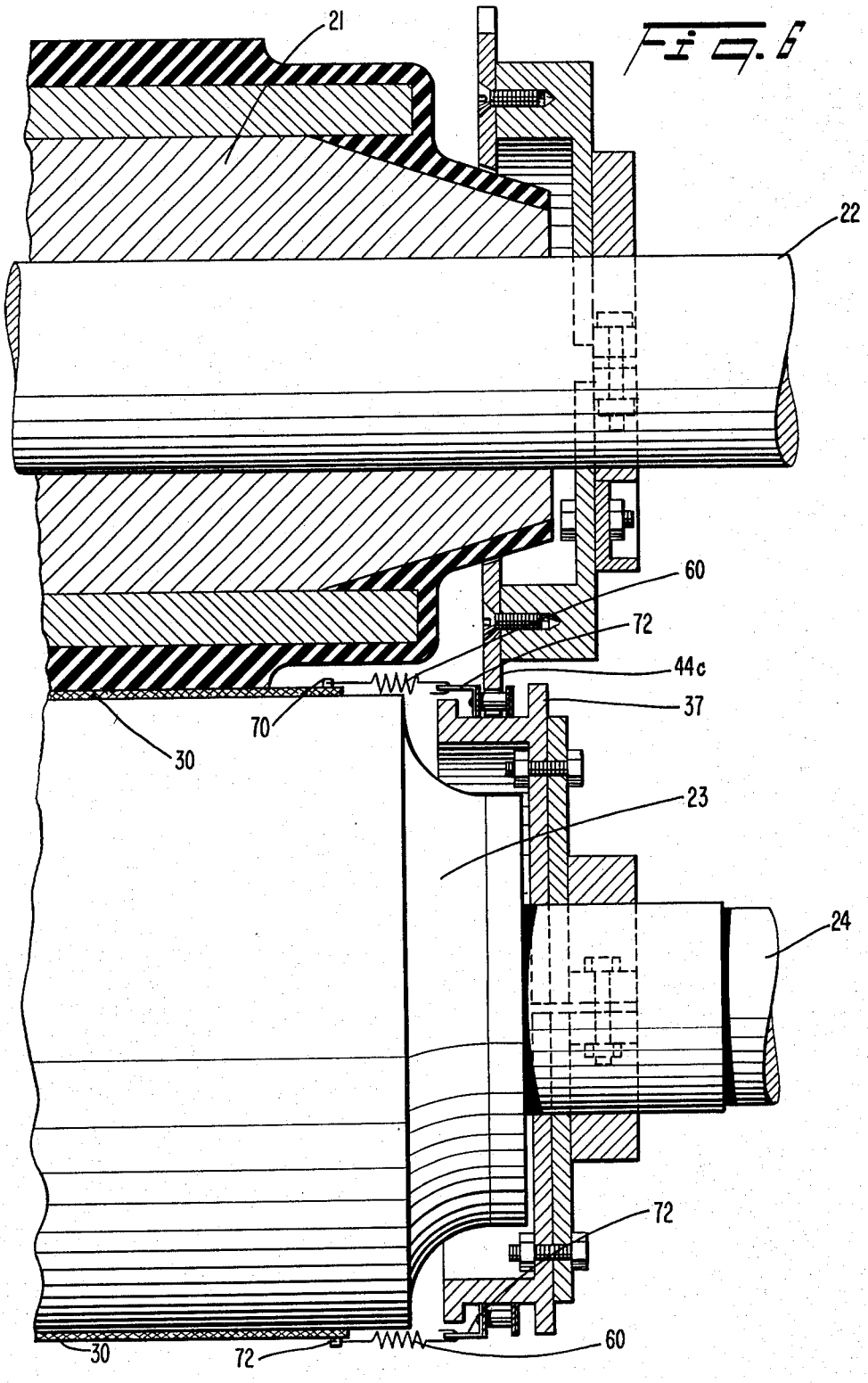
FIG. 6 is another preferred embodiment of the apparatus of FIG. 5.

In FIG. 5, the grooved pulley 37 is fixed to the roll 23. With reference to FIG. 6, the grooved pulley 37 may be mounted on the shaft 24 of the bottom squeeze roll 23 in a fashion to permit free wheeling rotation of the pulley 37 independent of the rotational speed of shaft 24. The selvedges of the conveyor belt fabric are attached by lacings or springs 60 secured to the guiding chain 32.

Figure 7:
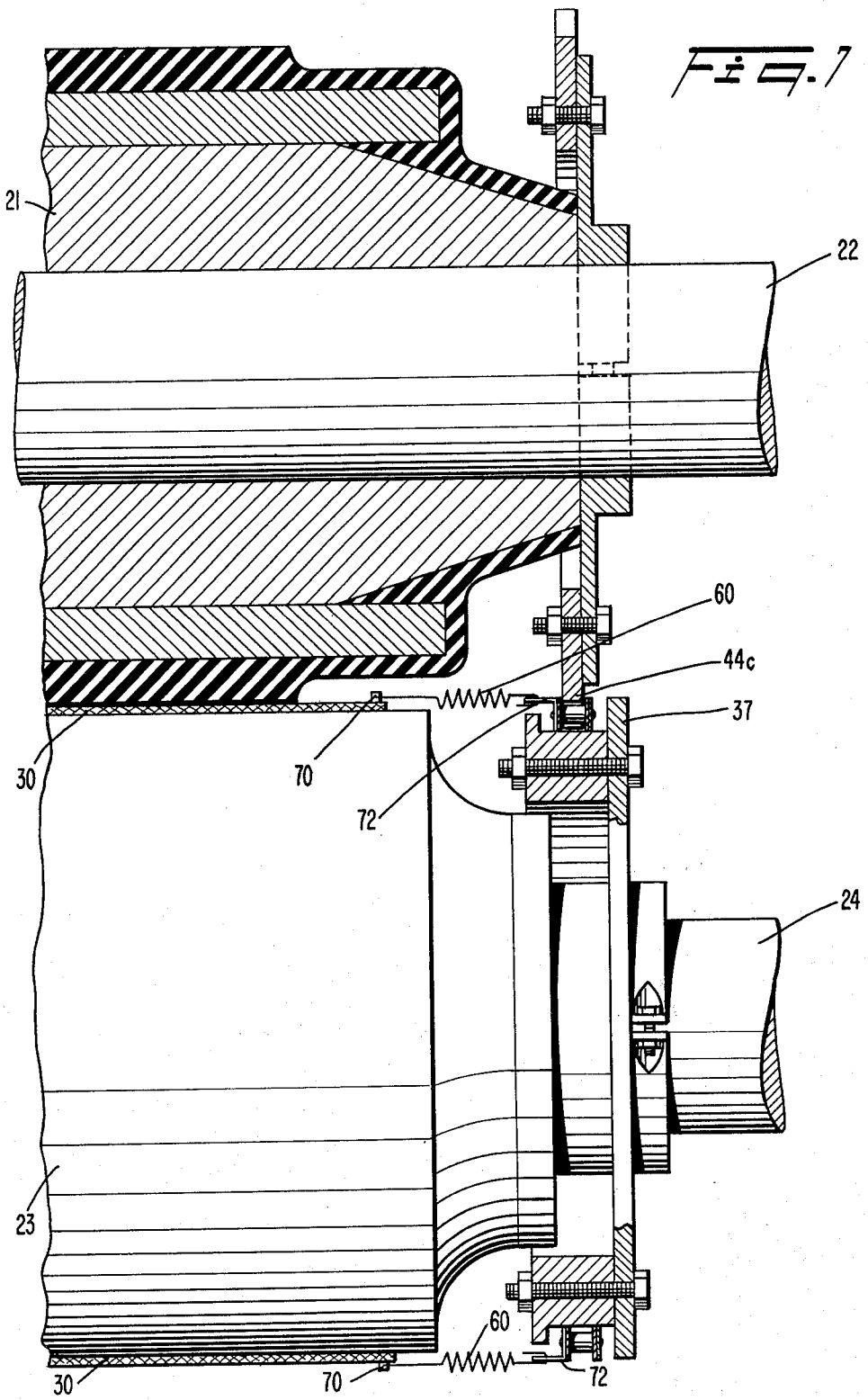
FIG. 7 is yet another preferred embodiment of the apparatus of FIG. 5.

FIG. 6 illustrates matching free wheeling sprocket and pulley arrangements added to the upper and lower squeeze rolls 21, 23 respectively by split collars. FIG. 7 illustrates similar matching arrangements for adding free wheeling sprockets and pulleys to existing squeeze roll stands. The sprockets and pulleys need not be split as shown in FIGS. 5, 6 and 7 if the squeeze rolls are removed from the nip stand for installation of non-split sprockets and pulleys.

In operation, a wet batt is transferred from a wet processing stage of a fiber treatment system by a first primary conveyor belt to a space defined between an auxiliary conveyor belt and an upper squeeze roll. The batt is squeezed between the auxiliary conveyor belt and the upper squeeze roll to expel at least a portion of the liquor within the batt. The expressed liquor passes directly through the porous fabric of the auxiliary conveyor belt as the pressure exerted by the belt and the upper squeeze roll continuously increases until the belt and the batt pass through a nip formed by the upper squeeze roller and a lower squeeze roller. The batt is then conveyed by the auxiliary conveyor belt to a second primary conveyor belt and to a subsequent stage of the fiber treatment system.

The auxiliary conveyor belt travels in a continuous path over a first turn roll, through the nip of the squeeze rolls, then over a second turn roll, beneath the lower squeeze roll and back to the first turn roll. The belt may be aligned by crowned surfaces of the first or second turn rolls or by a third turn roll provided between the second turn roll and the lower squeeze roll. The third turn roll may be selectively pivotable about a mid portion of its axis of rotation to align the belt.

Either the first turn roll or the second turn roll is selectively urged away from the nip of the squeeze rolls to appropriately tension the belt.

If provided, chains connected along either edge of the belt travel over sprockets and pulleys of the various turn rolls and squeeze rolls. The sprockets and pulleys are selectively locked or allowed to "free wheel" relative to the associated turn rolls and squeeze rolls to guide and align the belt. A pair of the sprockets may be locked to a common shaft to constrain relative movement of one chain relative to the other chain in a machine direction. Similarly, a pair of the sprockets may be locked to a common shaft with a drive assist provided to reduce the amount of driving force required of the auxiliary conveyor belt to drive the chains in the machine direction. In this way, the torque driving assist partially drives the chains to overcome a frictional drag resistance of the sprocket and pulley arrangements and hence minimizes a machine direction tension in the springs connecting the chains to the conveyor belt. Individual or paired sprockets can be moved so as selectively to absorb slack in the chains without increasing slack in the auxiliary conveyor belt fabric.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of extracting liquor from a non-woven textile fiber batt, comprising the steps of:

conveying a wet textile fiber batt to an upper squeeze roll;

squeezing the textile fiber batt between a porous conveyor belt and the upper squeeze roll to expel a fraction of the liquor carried by the textile fiber batt, said fraction of the liquor being gradually expelled as the textile fiber batt is progressively squeezed between the porous conveyor belt and the upper squeeze roll;

carrying said textile fiber batt through a nip defined by said upper squeeze roll and a lower squeeze roll to expel additional liquor from the textile fiber batt; and conveying the textile fiber batt away from the nip on the conveyor belt.

2. The method of claim 1 further comprising the steps of:

passing the conveyor belt sequentially over a first turn roll, through the nip, over a second turn roll and below the lower squeeze roll;

maintaining alignment of the conveyor belt on the first and second turn rolls; and selectively tensioning said conveyor belt to control the fraction of the liquor expelled from the textile fiber batt between the porous conveyor belt and the upper squeeze roll.

3. A method of extracting liquor from a non-woven textile fiber batt, comprising the steps of:

conveying a wet textile fiber batt to an upper squeeze roll;

squeezing the textile fiber batt between a porous conveyor belt and the upper squeeze roll to expel a fraction of the liquor carried by the textile fiber batt;

carrying said textile fiber batt through a nip defined by said upper squeeze roll and a lower squeeze roll to expel additional liquor from the textile fiber batt;

conveying the textile fiber batt away from the nip on the conveyor belt; and continuously guiding the conveyor belt by selectively pulling first and second edges of the conveyor belt away from one another transverse to the travel direction of the belt.

4. The method of claim 3 further comprising the steps of:

passing the conveyor belt sequentially over a first turn roll, through the nip, over a second turn roll and below the lower squeeze roll;

maintaining alignment of the conveyor belt on the first and second turn rolls; and selectively tensioning said conveyor belt to control the fraction of the liquor expelled from the batt between the porous conveyor belt and the upper squeeze roll.

5. The method of claim 4 wherein said alignment of the conveyor belt is maintained by first and second guiding chains provided along first and second edges of the belt, the first and the second chains being flexibly connected to said first and second edges and wherein the chains are restrained from lateral movement perpendicular to the machine direction path of travel of the conveyor belt and the guiding chains by a plurality of pulleys and sprockets.

6. The method of claim 5 wherein said first and second chains are selectively tensioned independently of one another.

7. The method of claim 6 wherein said first and second chains are selectively driven in unison.

8. The method of claim 5 further comprising the step of selectively tensioning said first and second chains, independently of the conveyor belt fabric.

9. The method of claim 8 wherein said first and second chains are selectively tensioned independently of one another.

10. The method of claim 8 wherein said first and second chains are selectively tensioned in unison.

11. The method of claim 5 wherein the conveyor belt is resiliently connected to the first and second edges of the belt.

12. A method of extracting liquor from a non-woven textile fiber batt, comprising the steps of:

conveying a wet textile fiber batt generally vertically downward to an upper squeeze roll;

squeezing the textile fiber batt between a porous conveyor belt and the upper squeeze roll to expel a fraction of the liquor carried by the textile fiber batt;

carrying said textile fiber batt generally horizontally through a nip defined by said upper squeeze roll and a lower squeeze roll to expel additional liquor from the textile fiber batt, said upper squeeze roll being generally vertically above said lower squeeze roll; and conveying the textile fiber batt away from the nip on the conveyor belt.

13. The method of claim 12 further comprising the steps of:

passing the conveyor belt sequentially over a first turn roll, through the nip, over a second turn roll and below the lower squeeze roll;

maintaining alignment of the conveyor belt on the first and second turn rolls; and selectively tensioning said conveyor belt to control the fraction of the liquor expelled from the textile fiber batt between the porous conveyor belt and the upper squeeze roll.

14. The method of claim 12 wherein the textile fiber batt contacts the upper squeeze roll before the textile fiber batt contacts the porous conveyor belt.

15. The method of claim 14 wherein the fraction of the liquor is gradually expelled as the textile fiber batt is progressively squeezed between the porous conveyor belt and the upper squeeze roll.

16. The method of claim 12 wherein the porous conveyor belt provides less than about 0.25 pound of liquor per square yard of belt for reabsorption into the batt.

17. The method of claim 1 wherein the porous conveyor belt provides less than about 0.25 pound of liquor per square yard of belt for reabsorption into the batt.

18. The method of claim 3 wherein the porous conveyor belt provides less than about 0.25 pound of liquor per square yard of belt for reabsorption into the batt.

19. The method of claim 1 wherein said textile fiber batt is carried generally horizontally through said nip and wherein said upper squeeze roll is generally vertically above said lower squeeze roll.

20. The method of claim 3 wherein said textile fiber batt is conveyed generally horizontally through said nip and wherein said upper squeeze roll is generally vertically above said lower squeeze roll.

21. The method of claim 1 wherein the textile fiber batt is progressively squeezed between the conveyor belt and the upper squeeze roll over a sector of the upper squeeze roll of at least 45° prior to passing through the nip.

22. The method of claim 3 wherein the textile fiber batt is progressively squeezed between the conveyor belt and the upper squeeze roll over a sector of the upper squeeze roll of at least 45° prior to passing through the nip.

* * * * *